United States Patent [19]

Harzl et al.

[11] Patent Number: 4,863,107

[45] Date of Patent: Sep. 5, 1989

[54] PROCESS AND A DEVICE FOR REMOVING FOREIGN SOLIDS FROM PULPERS

[75] Inventors: Erich Harzl; Karl Maier, both of Graz; Sirous Namdar, St. Oswald, all of Austria

[73] Assignee: Maschinenfabrik Andritz Actiengesellschaft, Graz, Austria

[21] Appl. No.: 38,275

[22] Filed: Apr. 15, 1987

[30] Foreign Application Priority Data

Apr. 16, 1986 [AT] Austria ..... 996/86

[51] Int. Cl.[4] ..... B02C 23/36

[52] U.S. Cl. ..... 241/21; 241/24; 241/46.17; 241/69

[58] Field of Search ..... 162/261, 4; 241/46.17, 241/69, 46.02, 80, 46.04, 97, 46.11, 21, 24, 28, 79

[56] References Cited

U.S. PATENT DOCUMENTS

| | | | |
|---|---|---|---|
| 4,369,093 | 1/1983 | Lamort | 241/79 X |
| 4,420,117 | 12/1983 | Peroutka et al. | 241/46.17 X |
| 4,538,765 | 9/1985 | Mayr et al. | 241/46.17 X |
| 4,582,261 | 4/1986 | Perry | 241/46.17 X |
| 4,634,059 | 1/1987 | Bahr et al. | 241/46.17 X |

FOREIGN PATENT DOCUMENTS

| | | |
|---|---|---|
| 3221932 | 12/1983 | Fed. Rep. of Germany . |
| 3311082 | 9/1984 | Fed. Rep. of Germany . |

*Primary Examiner*—Mark Rosenbaum

*Attorney, Agent, or Firm*—Townsend and Townsend

[57] ABSTRACT

For removing foreign solids, for instance contaminants, from pulpers in which waste paper, in particular with a share of more than five percent, for instance more than ten percent, of solids foreign to paper, is pulped or suspended and the suspension or slurry is the withdrawn through a screen zone for further processing, it is proposed according to the invention to at least partially withdraw the suspension or slurry from the pulper in periodic time intervals and, subsequent to the, in particular each, partial withdrawal of the suspension or slurry, to loosen, hydrodynamically or by means of fluids, the foreign solids accumulated on one side, in particular the upper side, of the screen zone, whereupon the dirt slurry obtained by hydrodynamical loosening is fully mechanically discharged from the pulper prior to newly charging the pulper. The hydrodynamical loosening of the foreign solids is preferably effected under backflushing through the screen zone. Liquid for hydrodynamical loosening is withdrawn from the hydrodynamically loosened slurry in at least one step, in particular through a filter, preferably through a rotary screen. The withdrawn liquid for hydrodynamical loosening is conveniently recycled. A device for carrying out the process according to the invention is conventiently provided with a hydrodynamical loosening means for hydrodynamically loosening foreign matter accumulated on one side of the screen zone and with a fully mechanical discharge means for the dirt slurry so obtained.

25 Claims, 1 Drawing Sheet

1
2
3
4
5
6
7
8
9
10
11
12
13
14

PROCESS AND A DEVICE FOR REMOVING FOREIGN SOLIDS FROM PULPERS

The invention relates to a process and a device for removing foreign solids, for instance dirt, from pulpers or beaters in which waste paper containing more than five percent, for instance more than ten percent, of solids other than paper is suspended and the suspension or slurry is then withdrawn through a wire or screen zone for further processing.

The half stuff, a.o. waste paper, is pre-comminuted in devices called pulpers for paper stock or stuff production. In this wet process, pulpers provided with a ragger and a junk remover are used for processing the waste paper. The floating components not dissolving in water, such as wet-strength paper, wire and the like, form a rag, the sinking metal or glass components are removed from the pulper by means of a bucket conveyor or trash discharge.

Waste paper which is to be recycled in the paper industry contains, depending on its origin, various amounts of components foreign to paper which naturally have disagreeable effects. Such foreign components are all those foreign materials present in the waste paper which might cause damage to the machinery during processing or trouble in the course of production and reduce the value of the finished product. Foreign materials in waste paper are above all metals, string, glass, textiles, wood, sand, building materials, plastic materials, so called "synthetic papers", waste of all types and origins and the like.

Sorted waste paper must not contain more than a maximum of one percent of such foreign solids, in the case of mixed waste paper, this portion amounts to about three percent and in the case of highly soiled waste paper such as it accumulates, for instance, as a fraction of a garbage disposal plant, the percentage may be as high as, and even exceed, twenty to thirty percent.

The ragger retrieves only a portion of these solids. All the rest of the material which does not pass through the screen zone and is not intercepted by the junk remover forms a deposit on the screen zone and in the course of time leads to the formation of a layer impeding the operation of the pulper having to be removed periodically. A further disadvantage, next to the clogging of the screen zone, resides in the fact that the foreign solids are also slowly comminuted in the operation of the pulper and are then entrained together with the broken paper stuff (pulp) through the screen zone into the further processing steps.

In practice, the removal of the ragging and the deposits of solids on the screen zone causes considerable difficulties; the pulpers have to be shut off, emptied and cleaned, sometimes several times during one work shift, which often can be done only manually and is a very disagreeable job.

The following systems for the automatic cleaning of pulpers are known:

a system with continuous or cyclic withdrawal of a portion from the pulper to a cleaning device which usually has a dissolving effect, with subsequent return of the cleaned paper stuff portion or forwarding to the discharge hamper;

a system with emptying the entire paper pulp over a perforated drum, with the disintegrated pulp falling through the perforations and the contaminants being retained in the drum and discharged on its end;

a system with periodic emptying of the entire disintegrated pulp over a device with disintegrating effect and perforated plate, with the contaminants being retained by the plate.

These systems can only process lightly soiled waste paper; there is no possibility of a concerted interception of the foreign solids as the entire paper stock is treated.

It is thus the object of the invention to provide a process and a device in which the foreign solids can be concertedly intercepted, i.e. the portion of paper stock can be kept very low, and can be discharged as such from the pulper fully mechanically.

In order to achieve this object, it is proposed according to the invention to withdraw the suspension or slurry at least partially from the pulper in periodic time intervals and, subsequent to the, in particular each, partial withdrawal, to loosen, hydrodynamically or by means of fluids, the foreign solids accumulated on one side, in particular the upper side, of the screen zone, whereupon this dirt phase is fully mechanically discharged from the pulper prior to newly charging the pulper.

"At least partially" is understood to mean the completest possible separation of the paper stock portion of the pulper content, for instance a separation of ninety five to ninety seven percent of the paper stock portion of the pulper content, so that the smallest possible paper stock residue remains in the mass of the foreign solids.

Further advantageous features of the process according to the invention which may be applied alone or in any given combination are the following:

The foreign solids are hydrodynamically loosened through the screen zone by back flushing.

The liquid for hydrodynamic loosening is withdrawn in at least one step from the hydrodynamically loosened matter after discharge from the pulper, the liquid for hydrodynamic loosening is preferably recycled to the pulper.

The liquid for hydrodynamic loosening is withdrawn in a filter, in particular a rotary screen which is preferably formed as a step drum or cone drum with thick matter conveyor and is preferably provided with thick matter looseners which convey the thick matter up on the drum wall without an advance component so that it drops back into the drum.

The foreign solids are compacted subsequent to discharge from the rotary screen under further release of liquid.

A device for carrying out the process according to the invention is thus conveniently provided, above all, with a means for loosening hydrodynamically or by means of fluids, foreign matter accumulated on one side, in particular the upper side, of the screen zone as well as a fully mechanical discharge means for this dirt phase.

Further advantageous features of the device according to the invention, which may be realized alone or in any given combination, are the following:

A filter, in particular a rotary screen, is provided for the separation of hydrodynamic loosening liquid from the hydrodynamically loosened slurry of the foreign solids.

The rotary screen is provided with a restriction and formed as a step drum or cone drum and provided with thick matter conveyors, in particular a drive helix, and preferably with looseners for the thick matter.

The rotary screen is arranged with its axis ascending in conveying direction.

A return means of the hydrodynamic loosening liquid to the pulper is provided.

It is provided for the rotary screen to be partially immersed in the bath of hydrodynamic loosening liquid.

A cone drum in which charge and discharge are arranged on the same side of the drum is provided and preferably formed for a driving operation with reverse rotating direction.

A dewatering (dehydrating) press for the foreign solids discharged from the rotary screen is provided.

Further provided is a sediment discharge with automatic discharge below the filter, in particular below the rotary screen.

The invention is explained in detail by means of an exemplary embodiment under reference to the schematic representations in the drawing wherein FIG. 1 shows a plant diagram;

Figures 1, 2, 3:
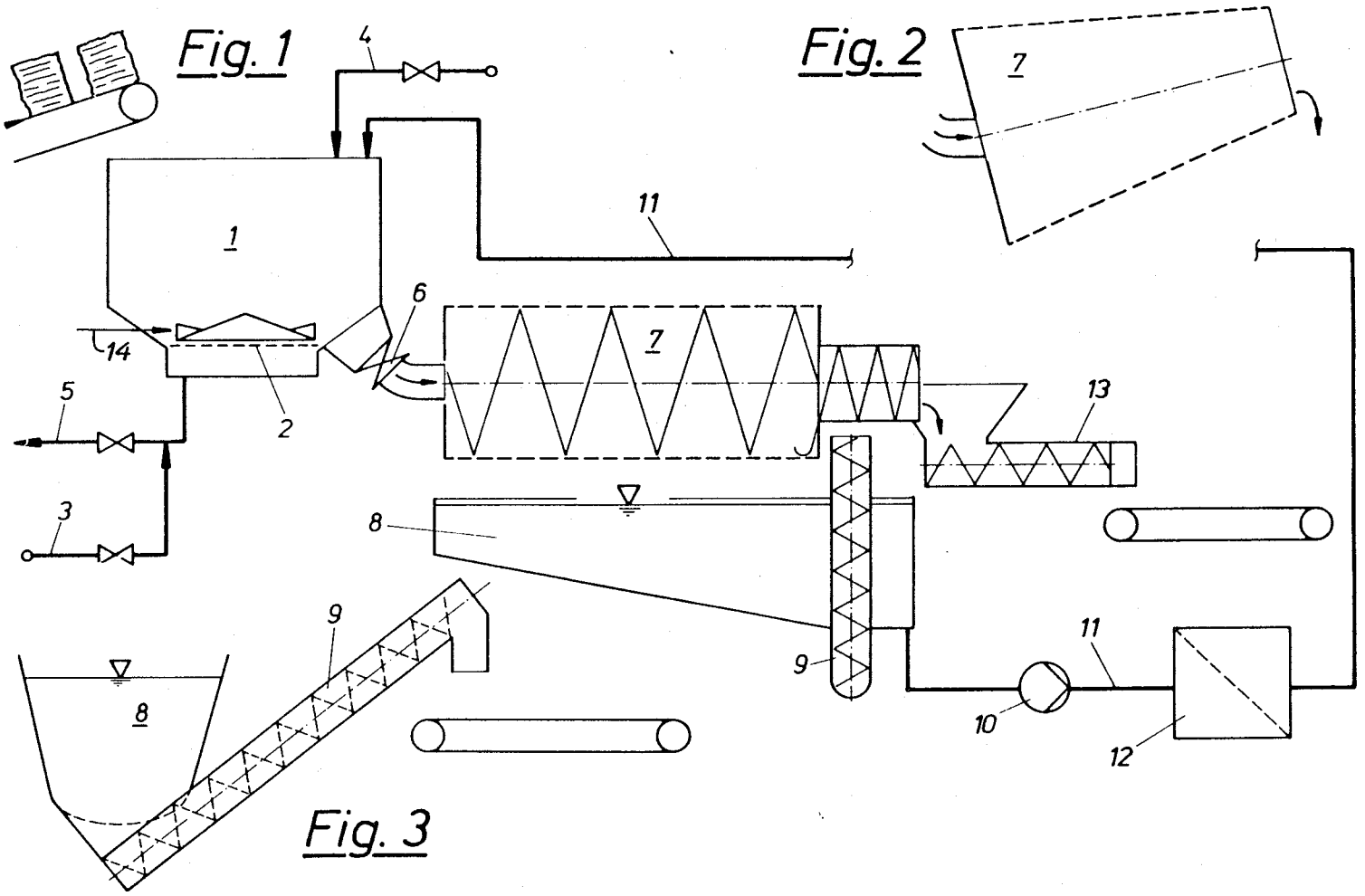
FIG. 2 shows an optional embodiment of the rotary screen.
FIG. 3 shows a different view of the sediment discharge represented in FIG. 1.

The waste paper is charged into the pulper in bales or loosely in a manner known per se, the periodic or continuous disintegration is effected in the pulper by means of diluting water.

The diluting water used is normally purified or unpurified recycled water; it is also possible to add fresh water. At periodic pulping operation, the addition of diluting water is preferably effected through the perforated plate 2 of the pulper in order to prevent clogging of the plate (feed line 3). At continuous pulping operation, the amount of diluting water is added from the top as usual (feed line 4). The disintegrated pulp suspension is discharged through the perforated plate 2 and the orifice 5 and passed on for further processing.

The purification cycle according to the invention is initiated by the complete pumping of the pulp suspension from the pulper. It is convenient to apply an intermediary dilution of the residue and repeated pumping in order to minimize the content of paper stock in the retained contaminants.

The amount of contaminants to be discharged is retained by the perforated plate 2 after evacuation of the pulp suspension from the pulper and is then hydrodynamically loosened by the addition of recycling water via feed line 3 to five to ten percent of the pulper volume, is then flushed out of the pulper and passed into a perforated drum 7 after opening of the lock (sluice) 6. After closing of the lock 6, the pulper 1 is ready for operation again.

In the perforated drum 7, the diluting water used for flushing is removed and the amount of contaminants is homogenized so that it can be discharged from the perforated drum continuously. In order to prevent overflowing in the case of charging in batches and continuous discharge, the perforated drum 7 is, according to the invention, preferably formed as a step drum or, as represented alternatively, as a cone drum (FIG. 2).

The water flowing from the perforated drum 7 empties into the sedimentation basin 8. This is provided with a discharge means 9 for sediment components, preferably a screw conveyor. The portion of contaminants discharged by means of the discharge means 9 is dehydrated in the conveying means to the extent that it can be placed directly into a garbage container or on a belt conveyor. The diluting water thus freed of sedimentary components can be recycled to the pulping operation by means of pump 10 and line 11 directly or via a water purification plant 12 provided upstream.

The contaminants are homogenized in the perforated drum 7 by its rotation, a brief reversal of the rotating direction may prove useful. Thick matter looseners are provided for homogenizing; these may be catch pockets lifting thick matter up along the circumference of the drum during its rotation, essentially without an advance component, in the direction of the axis of the drum until the thick matter drops back to the bottom of the drum due to the force of gravity.

The contaminants dehydrated in the perforated drum are discharged continuously into a dehydrating means 13, preferably using screw compacters. Downstream of the dehydrating means 13, the dehydrated contaminants may be passed directly to a garbage container or onto a belt conveyor.

The previously described purification operation of the pulper can be carried out after each pulping operation in case of an extremely high amount of contaminants. At low amount of contaminants and periodic pulper operation, the purification cycle can be carried out, for instance, after each second or third pulper charge. At continuous pulper operation, the purification cycle can be preset by means of automatic timer depending on the amount of contaminants.

In each case, it is assured that the entire purification cycle takes place in due time and fully automatically, no further manual intervention being necessary. This includes a fully automatic control of the entire operation.

The screen zone of the pulper is normally a perforated metal sheet or the like. In order to support the hydrodynamic loosening of the accumulation of foreign solids at the screen zone, it is possible, for instance, to direct one or several jet(s) of hydrodynamic loosening fluid 14, preferably at simultaneous reflushing through the screen zone into the inner space of the pulper, into this accumulation, preferably parallel to the screen zone limit and at a small distance to it. The hydrodynamic loosening can optionally be carried out in several steps, with at least one preliminary step for flushing the paper stock content which is discharged separately.

As a rule, the hydrodynamic loosening fluid used will be water, above all industrial water, which also serves as a menstruum in the pulper; but it would also be possible to use other liquids.

The hydrodynamic loosening fluid is preferably recycled to the pulper, optionally following an intermediary purification, for instance by means of filters, and is there used as a pulping or hydrodynamic loosening liquid.

The hydrodynamic loosening of the foreign solids is obtained in batches, but preferably continuously processed under separation of hydrodynamic loosening fluid. Any given known mechanical filter means such as band filters or drum filters can be used for this purpose. The filters may be charged in batches or continuously. When charging in batches, for instance, the entire hydrodynamic loosening phase is charged into a drum filter of suitable dimensions at one time. Cylindrical step drums in which at least one cylinder of small cross section follows a cylinder of larger cross section in the conveying direction of the solids or conical drums tapering in conveying direction are particularly suitable for this purpose. In the case of cylindrical step drums, the volumetric ratio between the larger receiving portion and the smaller processing portion may be up to 20:1 or more, preferably about 10:1.

The liquid separating drums are conveniently provided with an interior solids conveying means, in particular a positive (forced) conveyor, for instance a conveyor spiral, and may be immersed in sections, above all by their receiving sections, over part of their circumference in a bath of hydrodynamic loosening liquid or fluid.

The axes of the liquid separating drums can ascend in solids conveying direction so that the solids of progressively decreasing liquid content are ascendingly conveyed from the wet phase. As evident from the drawing, this may also be realized in respect of sediment separation.

The interior conveying in the drums also serves for the homogenization of the solids phase, with paper stock portions conveyed to the surface and flushed out.

A preferred arrangement with a conical liquid separating drum for batch operation provides for the drum to be charged and emptied on one side, with the drive of the drum disposed on the other side. By reverting of the drive, it is possible to provide for a forward conveyance of the solid phase which is too dry and then a return conveyance for discharge from the drum.

The process according to the invention and the devices according to the invention are particularly suitable for the processing of heavily soiled waste paper grades, in particular those containing more than five percent, for instance up to ten percent, of foreign solids. This permits the processing of charges of this type on a larger scale; particular operational advantages and a far higher product quality are obtained in the processing of less soiled waste paper charges according to the invention.

We claim:

1. In a process for removing foreign solids from pulpers in which waste paper is suspended and the suspension is withdrawn through a screen zone for further processing, the improvement comprising that the suspension is partially withdrawn from the pulper and sieved in the pulper at periodic time intervals and, subsequent to a first of said periodic partial withdrawals of the suspension and before a second of said periodic partial withdrawals, the foreign solids accumulated on one side of the screen zone are loosened hydrodynamically to produce a dirt slurry by supplying the pulper with a first and second source of liquid, said first source directed upwardly through the screen, said second source directed, simultaneously with said first source, into said accumulated foreign solids, said second source not passing through said screen, whereupon the dirt slurry so obtained is fully mechanically removed from the pulper.

2. The process according to claim 1, wherein the foreign solids are hydrodynamically loosened by backflushing through the screen zone.

3. The process according to claim 1, wherein the liquid for hydrodynamic loosening is removed in at least one step from the hydrodynamically loosened slurry after removing it from the pulper or beater.

4. The process according to claim 3, wherein the liquid for hydrodynamic loosening is recycled to the pulper or beater.

5. The process according to claim 3, wherein the liquid for hydrodynamic loosening is withdrawn from the hydrodynamically loosened slurry through a filter.

6. The process according to claim 3, wherein the liquid or hydrodynamic loosening is withdrawn from the hydrodynamically loosened slurry through a rotary screen.

7. The process according to claim 6, wherein the liquid for hydrodynamic loosening is withdrawn from the hydrodynamically loosened slurry through a rotary screen provided with thick matter looseners.

8. The process according to claim 6, wherein the foreign solids are compacted under further elimination of liquid after discharge from the rotary screen.

9. The process according to claim 3, wherein the liquid for hydrodynamic loosening is withdrawn from the hydrodynamically loosened slurry through a rotary screen formed as a step drum provided with a thick matter conveyor.

10. The process, according to claim 3, wherein the liquid for hydrodynamic loosening is withdrawn from the hydrodynamically loosened slurry through a rotary screen formed as a cone drum provided with a thick matter conveyor.

11. In a device for removing foreign solids having a pulper, a screen zone, and a means for suspending waste paper, the improvement comprising that the pulper is provided with a means for partially withdrawing the suspension through said screen zone at periodic time intervals, and a means in the pulper for hydrodynamically loosening foreign solids accumulated on one side of the screen zone to produce a dirt phase by supplying the pulper with a first and second source of liquid, said first source directed upwardly through the screen, said second source directed, simultaneously with said first source, into said accumulated foreign solids, said second source not passing through said screen, as well as a fully mechanical discharge means for this dirt phase, said means for hydrodynamically loosening, including means for initiating said loosening between two of said periodic partial withdrawals.

12. The device according to claim 11, wherein a filter is provided for separating the liquid for hydrodynamic loosening with the hydrodynamically loosened slurry of foreign solids.

13. The device according to claim 12, wherein a sediment outlet with automatic discharge is arranged underneath the filter.

14. The device according to claim 11, wherein a rotary screen is provided for separating the liquid for hydrodynamic loosening from the hydrodynamically loosened slurry of foreign solids.

15. The device according to claim 14, wherein the rotary screen is arranged with its axis ascending in conveying direction.

16. The device according to claim 14, wherein a bath of liquid for hydrodynamic loosening into which the rotary screen is partially immersed is provided.

17. The device according to claim 14, wherein a dehydrating press for the foreign solids discharged from the rotary screen is provided.

18. The device, according to claim 14, wherein the rotary screen is formed as a cone drum provided with a thick matter conveyor.

19. The device according to claim 11, wherein a rotary screen with a restriction is provided for separating the liquid for hydrodynamic loosening from the hydrodynamically loosened slurry of foreign solids.

20. The device according to claim 14, wherein the rotary screen is formed as a step drum provided with a thick matter conveyor.

21. The device according to claim 20, wherein the step drum is formed with charge and discharge on the same side of the drum and provided with a drive with reverse of rotating direction.

22. The device according to claim 14, wherein the rotary screen has a thick matter conveyor and is provided with thick matter looseners.

23. The device according to claim 11, wherein a means for recycling the liquid for hydrodynamic loosening to the pulper is provided.

24. In a device for removing foreign solids having a pulper and a screen zone, means for suspending waste paper and means for withdrawing the suspension through the screen zone, the improvement comprising means for partially withdrawing the suspension from the pulper at periodic time intervals, and sieving in the pulper, said suspension being partially withdrawn, the pulper having means separately supplied by a first and second source of liquid for hydrodynamically loosening foreign solids accumulated on one side of the screen at periodic time intervals and subsequent to said periodic partial withdrawals and sieving of the suspension to provide a dirt phase, and fully mechanical discharge means for the dirt phase, said first source directed upwardly through the screen, said second source directed, simultaneously with said first source, into said accumulated foreign solids, said second source not passing through said screen.

25. The device, according to claim 24, wherein the pulper has means separately supplied by back-flushing water.

* * * * *